US007331753B2

(12) United States Patent
Harazin

(10) Patent No.: US 7,331,753 B2
(45) Date of Patent: Feb. 19, 2008

(54) METHOD FOR COMPRESSING THE WORKING FLUID DURING A WATER/STEAM COMBINATION PROCESS

(75) Inventor: Wolfgang Harazin, Zwickau (DE)

(73) Assignee: Rerum Cognitio Gesellschaft fuer Marktintegration Deutscher Innovationen und Forschungsprodukte mbH, Zwickau (DE)

( * ) Notice: Subject to any disclaimer, the term of this patent is extended or adjusted under 35 U.S.C. 154(b) by 338 days.

(21) Appl. No.: 10/530,907

(22) PCT Filed: Jul. 14, 2003

(86) PCT No.: PCT/DE03/02357

§ 371 (c)(1),
(2), (4) Date: Apr. 8, 2005

(87) PCT Pub. No.: WO2004/010003

PCT Pub. Date: Jan. 29, 2004

(65) Prior Publication Data

US 2006/0083605 A1 Apr. 20, 2006

(30) Foreign Application Priority Data

Jul. 14, 2002 (DE) ..... 102 31 532

(51) Int. Cl.
*F01D 25/12* (2006.01)

(52) U.S. Cl. ..... 415/1; 415/116; 60/39.53; 60/775

(58) Field of Classification Search ..... 415/1, 415/116, 180, 176; 60/775, 39.3, 39.53
See application file for complete search history.

(56) References Cited

U.S. PATENT DOCUMENTS 2,549,819 A * 4/1951 Kane ..... 415/116

(Continued)

FOREIGN PATENT DOCUMENTS

EP 0 770 771 A1 5/1997

(Continued)

OTHER PUBLICATIONS

J. van Liere et al.: "Leistungssteigerung und $NO_x$-Reduktion der Gasturbinen durch SwirlFlash®-Overspray-Eindüsung", *VGB Power Tech*, No. 2, 2002, pp. 51-54.

*Primary Examiner*—Ninh H. Nguyen
(74) *Attorney, Agent, or Firm*—Laurence A. Greenberg; Werner H. Stemer; Ralph E. Locher

(57) ABSTRACT

A method for compressing the working fluid during a water/steam combination process in multi-stage turbocompressors comprising intercooling in the individual compressor stages, by the addition of a coolant to the working fluid. The aim of the invention is to provide a technical solution, which is suitable for the efficient intercooling of the working fluid during multi-stage compression and thus for the highest possible reduction of the required compressor power. To achieve this, dispersed water, which is obtained by the pressure atomization of water to form micro-droplets, is used as the coolant. The coolant is added directly to the working fluid in at least one compression stage in a quantity that maintains the thermodynamic equilibrium, and is converted during compression into the state of the working fluid, the evaporation of the coolant takes place at the saturation line. The addition of coolant between the compressor entrance and the compressor exit permits the mass flow of the working fluid to be increased.

6 Claims, 1 Drawing Sheet

U.S. PATENT DOCUMENTS

| | | | | |
|---|---|---|---|---|
| 5,331,806 | A | 7/1994 | Warkentin | |
| 5,644,911 | A | 7/1997 | Huber | |
| 5,669,217 | A * | 9/1997 | Anderson | 60/775 |
| 6,216,443 | B1 * | 4/2001 | Utamura | 60/39.53 |
| 6,453,659 | B1 | 9/2002 | Van Liere et al. | |

FOREIGN PATENT DOCUMENTS

| | | |
|---|---|---|
| EP | 1 138 955 A2 | 10/2001 |
| NL | 1 009 484 | 12/1999 |

* cited by examiner

METHOD FOR COMPRESSING THE WORKING FLUID DURING A WATER/STEAM COMBINATION PROCESS

BACKGROUND OF THE INVENTION

Field of the Invention

The invention relates to a method for compressing the working fluid in a combined cycle water/steam process in multi-stage turbocompressors with intercooling in the individual compression stages by addition of a coolant to the working fluid. Such a technical solution is required in the production of useful energy by means of combined cycle water/steam processes.

It is known that intercooling during the compression of the working fluid in turbocompressors reduces the compressor power required. It is known from gas turbine technology (J. van LIERE/C. G. MEIJER/G. H. M. LAAGLAND: Leistungssteigerung und Nox-Reduktion der Gasturbinen durch SwirlFlash®-Overspray-Eindüsung [Power increase and Nox reduction in gas turbines by SwirlFlash® overspray injection], VGB PowerTech 2/2002) to mobilize power reserves by reducing the compressor power by virtue of coolant addition during gas compression. For this purpose, finely atomized water in the form of mists made up of microdroplets is preferably used as coolant. When this technique is used, a two-phase working fluid is formed from the fuel gas or the flue gas and the evaporated coolant. In the first place, this leads to the desired reduction in temperature of the compressed working fluid and of the technical apparatus used. Furthermore, owing to the cooling processes, reductions in pollution gas concentrations in the flue gases are described. At the same time, however, it is entirely possible that the increase in moisture will lead to complications in the downstream process stages. The combined cycle water/steam process likewise aims to reduce the power requirements for compression by intercooling of the individual compression stages during the compression of the working fluid in the form of steam in order for it to be possible to take off greater useful power from the common turbine and compressor shaft. However, the indirect cooling of the compression stages turns out to be technically very complicated on account of the high flow rates. It has as yet not been possible to find a practicable and convincing technical solution to this problem for the combined cycle water/steam process.

SUMMARY OF THE INVENTION

The object of the invention is therefore to produce a technical solution with the aid of which the shortcomings of the known prior art can be overcome. In particular, a technical solution is required which is suitable for efficient intercooling of the working fluid during multi-stage compression and thus for maximum possible reduction of the compressor power.

The object is achieved by the features of claim 1. Preferred variant embodiments are described in the subclaims. Accordingly, during the compression of the working fluid of a combined cycle water/steam process ("WDK process") in multi-stage turbocompressors, the intercooling in the individual compression stages is carried out by addition of a coolant to the working fluid. For this purpose, very finely atomized water, which is obtained by pressure-atomization of water to form microdroplets, is used as coolant. The individual water microdroplets have diameters of less than 50 μm, preferably of between 2 and 20 μm. In this connection, the coolant in the form of water mists is added to the working fluid directly in at least one compression stage, the coolant passing into the state of aggregation of the working fluid during the compression operation.

The coolant is preferably supplied to the working fluid in such a quantity that the thermal equilibrium is maintained. In this connection, the evaporation of the coolant takes place along the saturation curve. The addition of coolant quantities between the compressor inlet and the compressor outlet results directly in an increase in the working fluid mass flow. The process engineering measures mentioned give rise to a number of desirable technical effects at the same time. By virtue of the evaporation heat required for the evaporation of the coolant being taken directly from the compression process, a reduction in the temperatures of compressed working fluid and technical apparatus is brought about. Parallel to this, the mass flow through the compressor is increased, and a reduced compressor power is required. The steam turbine operating on the same shaft can consequently deliver an increased net power.

In a particular embodiment it is provided for the coolant to be obtained from the liquefied working fluid of the WDK process in the form of steam condensate.

The possibility also exists of supplying the coolant to the working fluid even before the first compression stage. The thermal energy required for the evaporation of the coolant during compression is taken from the compression system, consisting of turbocompressor and working fluid, which leads directly to a reduction in the apparatus and medium temperatures. The mass flow of the working fluid in the turbocompressor can be made variable by virtue of the controllable addition of coolant proportions to the individual compression stages.

The compression volume is reduced owing to the internal cooling of the working fluid. For the purpose of intercooling during compression of the working fluid by means of turbocompressors, the use of cooling surfaces and the use of indirect cooling measures can, if required, be dispensed with.

The advantages of the invention consist in essence in the technical possibility now available of not only making the WDK process more energy-efficient but also of dispensing entirely with special measures in terms of technical apparatus for the purpose of intercooling of the working fluid between the individual compression stages in the form of cooling devices outside the turbocompressor or cooling measures on the compressor blades. Losses of working fluid occurring in the WDK process as a whole can be compensated specifically at least partly via the addition of coolant in the compression stage. In other cases, the working fluid removed from the WDK process for external purposes, for example when steam quantities are removed for heating purposes, can be replaced during the compression process by addition of coolant.

The invention is to be explained in greater detail below with reference to an illustrative embodiment.

DESCRIPTION OF THE PREFERRED EMBODIMENTS

Figure 1:
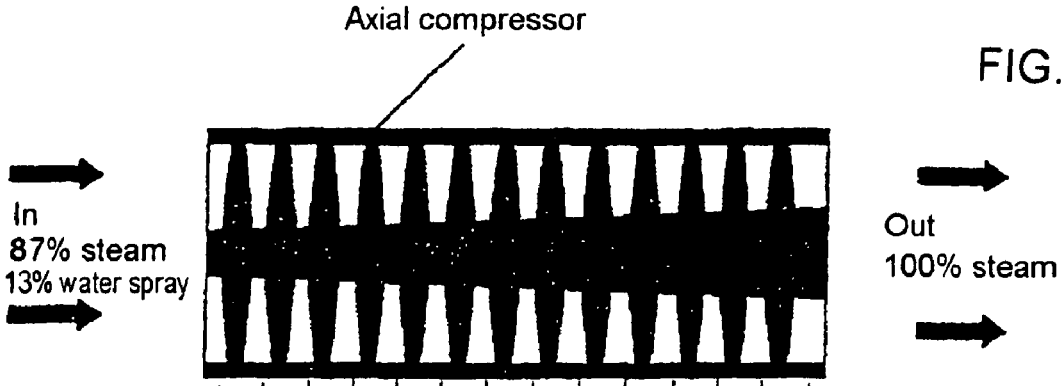
FIG. 1 shows a diagrammatic sectional illustration through a turbocompressor with an indication of the proportion of working fluid and coolant on entry into the turbocompressor.
Figure 2:
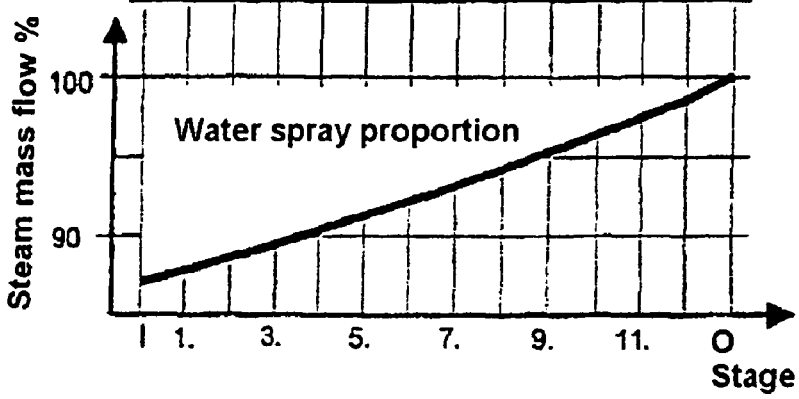
FIG. 2 shows a diagram to indicate the characteristic of the coolant proportion in the overall mass flow of working fluid and coolant over the individual stages of a 13-stage turbocompressor.

According to FIGS. 1 and 2, the expanded water vapour leaving the steam turbine is, in a WDK process, supplied to a turbocompressor arranged on the common shaft to be compressed again. The turbocompressor has 13 compression stages. Before the working fluid enters the turbocompressor, coolant is added to the working fluid in a ratio of 0.15 mass parts coolant to 1 mass part working fluid. In this connection, the coolant consists of a water spray, which is obtained by atomizing steam condensate. The diameters of the individual droplets of the water spray are smaller than 25 μm. Owing to the compression in stages of the mixture consisting of steam and water spray, a virtually continuous temperature increase, which runs parallel to the reduction of the coolant proportion in the overall mass flow, is achieved over the individual compression stages until the compressed working fluid leaves the turbocompressor. The compressed working fluid then returns to the steam turbine. The mechanical power obtained from the steam turbine is delivered to the turbine shaft. On account of the lower power of the turbocompressor, an increased excess power can be delivered to the outside on the turbine shaft. The direct addition of coolant to the working fluid dispenses with intercooling arrangements, which are complicated as far as technical apparatus and control are concerned, between the individual compression stages.

I claim:

1. A method for compressing a working fluid in a combined cycle water/steam process in multi-stage turbo-compressors with inter-cooling in individual compression stages, the method which comprises:

forming a coolant of very finely atomized water by pressure-atomization of water to form microdroplets;

adding the coolant to the working fluid directly in at least one compression stage, wherein the coolant passes into a state of the working fluid during compression, thereby adding the coolant to the working fluid in a quantity serving to maintain a thermodynamic equilibrium;

evaporating the coolant along a saturation curve; and adding the coolant between a compressor inlet and a compressor outlet to cause an increase in a working fluid mass flow.

2. The method according to claim 1, which comprises obtaining the coolant from liquefied working fluid.

3. The method according to claim 1, which comprises supplying the coolant to the working fluid before a first compression stage.

4. The method according to claim 1, which comprises removing a heat of evaporation of the coolant from the compression system and thereby reducing an apparatus temperature and a medium temperature.

5. The method according to claim 1, which rendering a mass flow of the working fluid in the turbo-compressor variable by controlled addition of the coolant to individual compression stages.

6. The method according to claim 1, which comprises reducing a compression volume by internal cooling of the working fluid.

* * * * *